US010899127B2

(12) United States Patent
Uroz Soria et al.

(10) Patent No.: US 10,899,127 B2
(45) Date of Patent: Jan. 26, 2021

(54) CONTROLLING PRINTING FLUID DROP EJECTION

(71) Applicant: HEWLETT-PACKARD DEVELOPMENT COMPANY, L.P., Spring, TX (US)

(72) Inventors: Juan Uroz Soria, Sant Cugat del Valles (ES); Santiago Sanz Ananos, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/336,029

(22) PCT Filed: Jan. 27, 2017

(86) PCT No.: PCT/US2017/015431

§ 371 (c)(1),
(2) Date: Mar. 22, 2019

(87) PCT Pub. No.: WO2018/140043

PCT Pub. Date: Aug. 2, 2018

(65) Prior Publication Data

US 2019/0270306 A1 Sep. 5, 2019

(51) Int. Cl.

| | |
|---|---|
| ***B41J 2/045*** | (2006.01) |
| ***B41J 2/07*** | (2006.01) |
| ***B41J 11/00*** | (2006.01) |
| ***B41J 19/14*** | (2006.01) |
| ***B41J 2/21*** | (2006.01) |

(52) U.S. Cl.
CPC ..... *B41J 2/07* (2013.01); *B41J 2/0458* (2013.01); *B41J 2/04556* (2013.01); *B41J 2/04573* (2013.01); *B41J 2/04581* (2013.01); *B41J 2/2135* (2013.01); *B41J 11/002* (2013.01); *B41J 19/145* (2013.01)

(58) Field of Classification Search
CPC .. B41J 2/04556; B41J 2/04573; B41J 2/2135; B41J 3/4073; B41J 25/001; B41J 25/00; B41J 25/304; B41J 25/308
See application file for complete search history.

(56) References Cited

U.S. PATENT DOCUMENTS

| | | | | |
|---|---|---|---|---|
| 6,471,315 | B1 | 10/2002 | Kurata | |
| 7,025,433 | B2 | 4/2006 | Lopez et al. | |
| 7,036,904 | B2 | 5/2006 | King et al. | |
| 7,055,925 | B2 | 6/2006 | Subirada et al. | |
| 7,611,217 | B2 | 11/2009 | Shamoun et al. | |
| 8,888,212 | B2 | 11/2014 | MacKenzie et al. | |
| 10,625,505 | B2 * | 4/2020 | Arakane | B41J 25/308 |
| 2005/0078134 | A1 | 4/2005 | Igarashi | |

(Continued)

FOREIGN PATENT DOCUMENTS

| | | |
|---|---|---|
| CN | 1997522 | 7/2007 |
| CN | 100345692 | 10/2007 |

(Continued)

*Primary Examiner* — Scott A Richmond
(74) *Attorney, Agent, or Firm* — HP Inc. Patent Department

(57) ABSTRACT

Examples are provided to methods to dynamically control the timing of a printing fluid drop ejection to deposit printing fluid on a print zone of a substrate. The examples may also provide measuring a height profile of a pre-print zone.

20 Claims, 7 Drawing Sheets

(56) References Cited

U.S. PATENT DOCUMENTS

| | | | | |
|---|---|---|---|---|
| 2005/0088469 | A1* | 4/2005 | Igarashi | B41J 2/04586 347/14 |
| 2005/0195229 | A1 | 9/2005 | Barss | |
| 2005/0248618 | A1 | 11/2005 | Pinard | |
| 2006/0214976 | A1 | 9/2006 | Iwao | |
| 2007/0064077 | A1 | 3/2007 | Konno | |
| 2009/0213160 | A1 | 8/2009 | Murai | |
| 2011/0032526 | A1 | 2/2011 | GottWals | |
| 2013/0074765 | A1 | 3/2013 | Heylen | |
| 2013/0257937 | A1* | 10/2013 | Arakane | B41J 11/001 347/8 |
| 2015/0029263 | A1 | 1/2015 | Arakane | |
| 2015/0273823 | A1* | 10/2015 | Kato | B41J 2/04556 347/9 |
| 2016/0089880 | A1 | 3/2016 | Herrmann | |
| 2017/0203579 | A1* | 7/2017 | Matsuhashi | B41J 11/002 |

FOREIGN PATENT DOCUMENTS

| | | | |
|---|---|---|---|
| CN | 101518994 | | 9/2009 |
| CN | 103459116 | | 12/2013 |
| CN | 104487259 | | 4/2015 |
| EP | 0925928 | A2 | 6/1999 |
| EP | 1313619 | A1 | 5/2003 |
| JP | H-1058668 | A | 3/1998 |
| JP | H10217479 | | 7/2004 |
| WO | WO-2015199715 | | 12/2015 |
| WO | WO-2016006209 | | 1/2016 |
| WO | WO-2016122592 | A1 | 8/2016 |

* cited by examiner

CONTROLLING PRINTING FLUID DROP EJECTION

BACKGROUND

A printer (such as an ink-jet printer, e.g., a latex ink printer) may comprise a printhead with a nozzle. A drop of printing fluid may be ejected from the nozzle towards a substrate.

DETAILED DESCRIPTION

Figure 1:
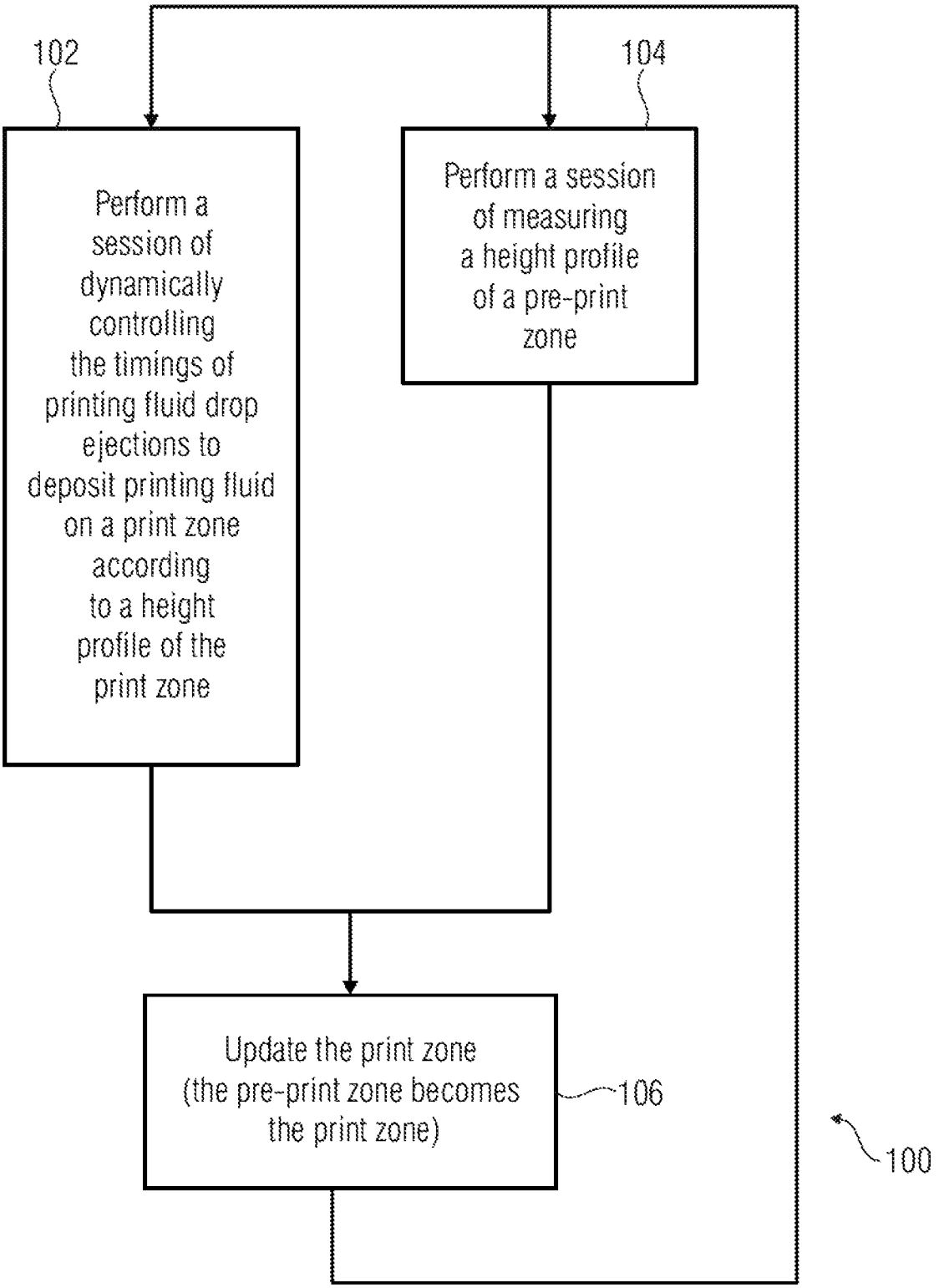
FIG. 1 shows a schematic view of a method according to an example.

A printer may apply printing fluid on a substrate. A printer may be a three-dimension (3D) printer or a two-dimension (2D) printer. A printer may be an ink-jet printer (e.g., a latex ink printer). A printer may comprise a printhead which ejects drops of printing fluid from a nozzle to the substrate. In general, a substrate may comprise, for example, paper, plastic, a bed of build material, a combination of these materials, or another material. Relative motions between the substrate and the printhead are performed to permit to apply drops to the whole surface of the substrate. A first relative motion may be performed in an advance direction (direction y), e.g., by moving the substrate using a conveyor. Additionally or alternatively, the printhead may be moved in the advance direction y. A second relative motion may be performed in a scan direction (direction x), e.g., by moving a carriage on which the printhead is mounted. While printing, the printhead may be moved from a first lateral border to a second lateral border of the substrate in the scan direction x, along a so-called swath; subsequently, the printhead may print while being moved in the scan direction x, backwards, e.g., from the second lateral border towards the first lateral border, along another swath; and so on.

In order to increase print speed, the printer may be controlled so that the printhead fires printing fluid drops while moving along the scan direction x. In view of the inertia, fired printing fluid drops move along parabolic trajectories. Therefore, the timing of the printing fluid drop ejection may be controlled on the basis of an estimation of the final position of the printing fluid drop on the substrate. In order to perform this operation, parameters such as the carriage speed and the height of the gap between the printhead (in particular in correspondence with the nozzle) and the substrate may be taken into account.

A latex ink printer (which may be a particular ink-jet printer) may make use of ink made of water-based ink such as latex ink (aqueous-dispersed polymer). A latex ink printer may be used, inter alia, for banners, signage, decoration, and high-quality print applications. Latex ink may provide high scratch-resistant, high durability, and good quality. A printer such as a latex ink printer uses internal heaters to produce forced airflows to dry and cure the ink, so as to obtain a complete print job. Heaters may be positioned in different sections of the printer to heat different portions of the substrate.

Further, in 3D printing, the bed of print material may also be heated.

Heating the substrate, and in particular heating different portions of the same substrate at different temperatures, however, tends to mechanically deform the substrate, e.g., by thermal expansion, or to ply the substrate. Therefore, the distance between the printhead and the substrate may be subjected to unpredictable variations. Hence, the gap between the nozzle and the substrate is not in general constant.

Unpredictable variations of the gap may cause print defects: the printing fluid drop may hit a location of the substrate which is not the intended one.

In accordance to examples, a method may comprise performing a session of dynamically controlling the timings of printing fluid drop ejections to deposit printing fluid on a print zone of the substrate according to a height profile of the print zone, while at the same time performing a session of measuring a height profile of a pre-print zone. Subsequently, when the pre-print zone becomes the print zone, it is possible to correctly control the trajectory of the printing fluid drop.

It is possible to dynamically control the timings of the drop ejections on the basis of the height profile measured while previously printing on other portions of the same substrate. For example, for a printer (such as a latex ink printer) in which heaters are provided to heat the substrate, a control may be performed to promptly modify the timing of the drop ejection to adapt to the irregular height profile caused by the temperature differences to which the substrate is subjected.

FIG. 1 shows a method 100 according to an example. At a block 102, the timing of printing fluid drop ejections to deposit printing fluid on a current print zone of the substrate is controlled on the basis of a height profile of the print zone. At block 104, which may be represented as being parallel to the block 102, the height profile of a pre-print zone may be measured. The method 100 may be reiterated. At each iteration, the pre-print zone is updated as the print zone and a new pre-print zone is selected. When the pre-print zone becomes the print zone (block 106), the height profile of the current print zone is already known and it is possible to perform a compensation of the irregular gap at each location of the current print zone. Therefore, the timing of the drop ejection may be controlled by keeping into account the irregularities in the gap between the substrate and the printhead. For example, while the printhead is moving along a swath and the nozzle is flung printing fluid drops on a succession of adjacent locations on the print zone, a distance detector may measure printhead-to-substrate distances in the pre-print zone.

Figure 2A:
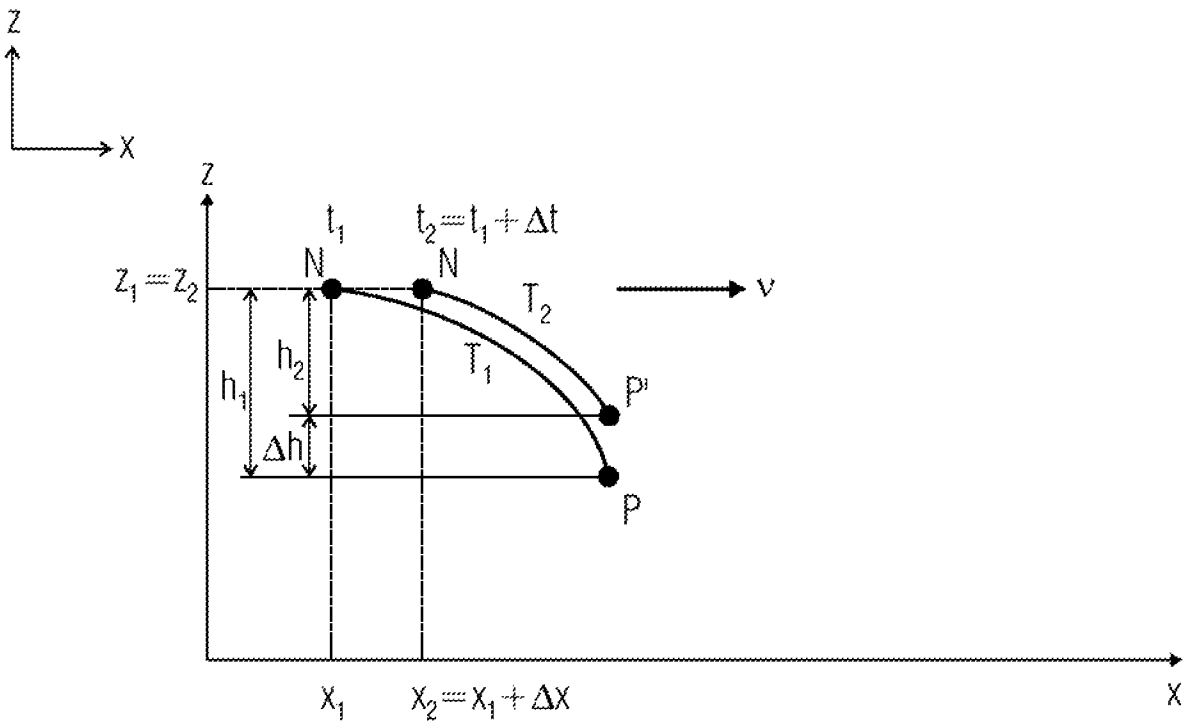
FIGS. 2*a*-2*d* show implementations according to examples.

FIG. 2*a* shows conceptually how to control ejection timing on the basis of the vertical position of a point which has to be covered by printing fluid (e.g., ink). A nozzle N may be moving at speed v in the scan direction x at a constant vertical coordinate $z_1$. The distance between the horizontal line along which the nozzle N moves and the point P is $h_1$. The printing fluid drop is to be ejected at a firing instant $t_1$ from a position with a horizontal coordinate $x_1$ to describe the trajectory $T_1$. The parabolic trajectory $T_1$ may be expressed mathematically as:

$$x(t)=x_1+v_{1x}t$$

$$z(t)=z_1-v_{1z}t-\tfrac{1}{2}gt^2$$

In the equation, $x_1$ and $z_1$ are coordinates associated to the position of the nozzle N at the firing instant $t_1$; $v_{1x}$ is the speed of the nozzle N in the scan direction x at the firing instant $t_1$; $v_{1z}$ is the speed at the firing instant in the vertical direction z; and g is the gravity acceleration. For convenience, it has been defined $t_1=0$. The equations describe a parabolic trajectory.

A comparative example may relate to an operation of covering with printing fluid the point P', which is at the distance $h_2$ from the horizontal line along which the nozzle N moves (vertical coordinate $z_2$ which is the same of $z_1$). The distance $h_2$ differs from $h_1$ by a quantity $\Delta h$. Accordingly, the printing fluid drop is to be ejected at time $t_2=t_1+\Delta t$, from position $x_2=x_1+\Delta x$, to describe a trajectory $T_2$. The trajectories $T_1$ and $T_2$ may be superposed to each other (if the speed v is the same for the examples).

It is therefore possible to estimate the final position of the printing fluid drop, if the value $h_1$ or $h_2$ is known. An accurate control of the final position of a printing fluid dot (e.g., an ink dot) on the substrate may be performed by appropriately timing the drop ejection.

FIG. 2*a* also shows that it is possible to define a threshold height. For example, the threshold height may be $h_1$. The threshold height may be associated to a default time instant $t_1$ at which printing fluid is to be fired from the nozzle to reach the point P at height $h_1$. It is possible to perform a compensation so that, when the gap is greater than the threshold, the printing fluid is fired at an instant (e.g., $t_2$) after the default time instant $t_1$. It is possible to provide that, when the gap is lower than the threshold, the printing fluid drop is fired at an instant preceding the default time instant $t_1$.

Figure 2B:
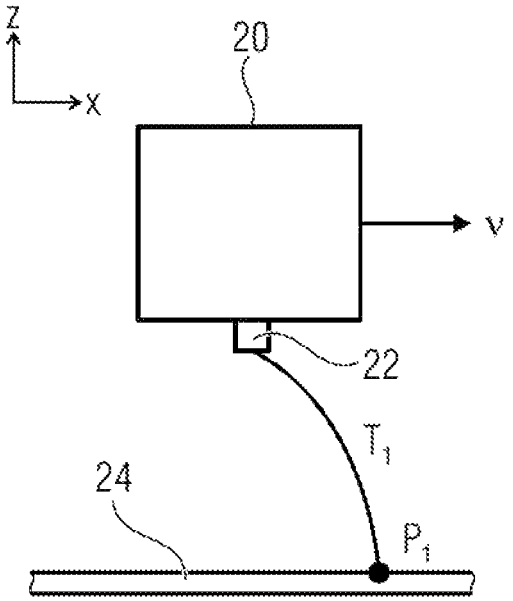

FIG. 2*b* shows a printhead 20 comprising a nozzle 22 (which may be the nozzle N of FIG. 2*a*) at a time instant $t_1$. The nozzle 22 fires a printing fluid drop (e.g., ink drop such as a latex ink drop) on a substrate 24 (e.g., paper), while the printhead 20 moves at speed v along the scan direction x (horizontal in the figure). A printing fluid drop follows the trajectory $T_1$ to arrive at the intended point $P_1$ on the substrate 24. Accordingly, a printing fluid dot is formed around the point $P_1$.

Figure 2C:
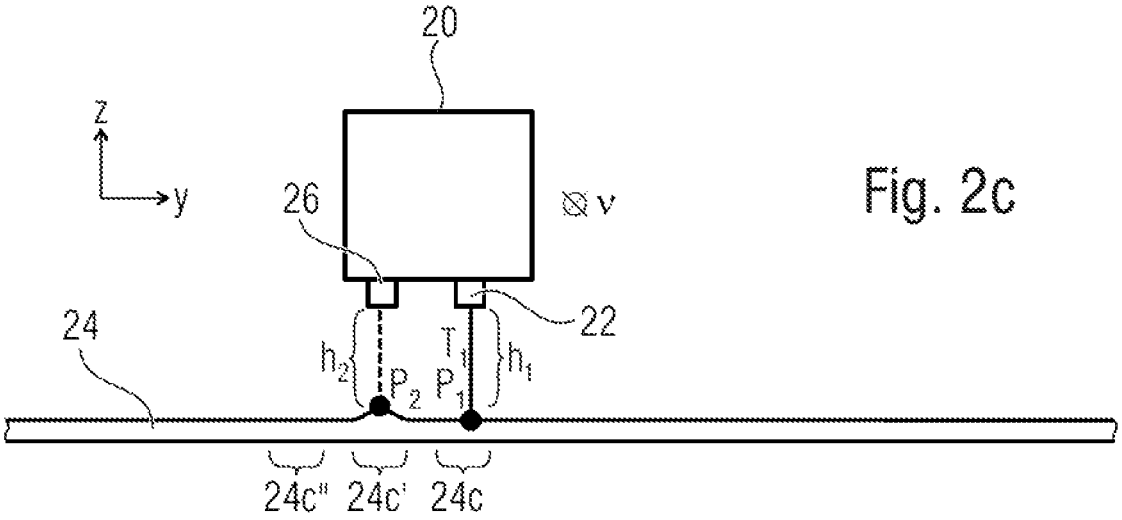

FIG. 2*c* shows another view of the printhead 20. The advance direction y is represented as horizontal in the figure, while the scan direction x enters in the figure. As shown by FIG. 2*c*, while a session of dynamically controlling the timings of ink drop ejections on a print zone 24*c* is performed, a session of measuring a height profile of a pre-print zone 24*c*' is concurrently performed. In proximity to the nozzle 22, a distance detector 26 may detect the height $h_2$ of the substrate 24 at a location corresponding to the point $P_2$, while the nozzle 20 is in the process of covering with printing fluid a print zone 24*c*. The region 24*c* containing the point $P_1$ is the current print zone; the location 24*c*' containing the point $P_2$ is the pre-print zone. While the printhead 20 moves forward or backward in the scan direction x, the distance detector 26 continues measuring the height of points of the substrate 24.

Figure 2D:
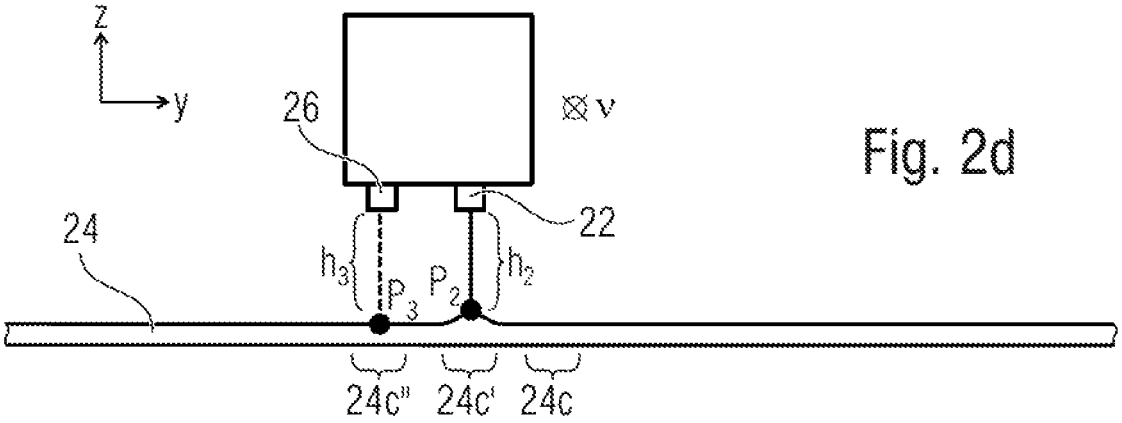

FIG. 2*d* shows the view of FIG. 2*c* at a subsequent time instant, i.e., while the current print region has become the region 24*c*'. As shown by FIG. 2*d*, while a session of dynamically controlling the timings of ink drop ejections on the print zone 24*c*' is performed, a session of measuring a height profile of a pre-print zone 24*c*" is concurrently performed. In FIG. 2*d*, the printhead is moving along a different swath with respect to that of FIG. 2*c*: if in FIG. 2*c*, the swath is entering in the figure, in FIG. 2*d* the swath is exiting from the figure. At the instant of FIG. 2*d*, the gap height h2 is known as it has been previously measured. Hence, it is possible to calculate the appropriate timing, for the ejection of the printing fluid drop to be placed on P2 at the instant of FIG. 2*d*. Notably, while the nozzle 22 fires the printing fluid drop toward P2, the distance detector 26 may detect the height h3 in the region 24*c*", which has become the pre-print zone, and which contains the point P3. Therefore, for each region, the height of the gap at each location that is to be covered with printing fluid at the subsequent swath may be measured. Basically, a height profile is measured for a region on which printing fluid is to be applied subsequently (pre-print zone).

In the figures discussed above and below, one single nozzle is shown for each printhead. However, each printhead may comprise a plurality of nozzles (e.g., arranged to form a matrix) which may fire printing fluid simultaneously to define a plurality of printing fluid dots on the substrate. The control of the timing of the ejection may be performed, for example, for each of the nozzles of the matrix or for the complete matrix of nozzles. Different printing fluid dots may be simultaneously generated by different nozzles of the same matrix.

The printhead may be a piezoelectric printhead (e.g., a piezoelectric inkjet printhead). The printhead may be a thermal printhead (e.g., a thermal inkjet printhead).

The printer may be a 2D printer (such as an ink-jet printer and a latex ink printer in particular) or a 3D printer which prints on a bed of build material.

Figure 3:
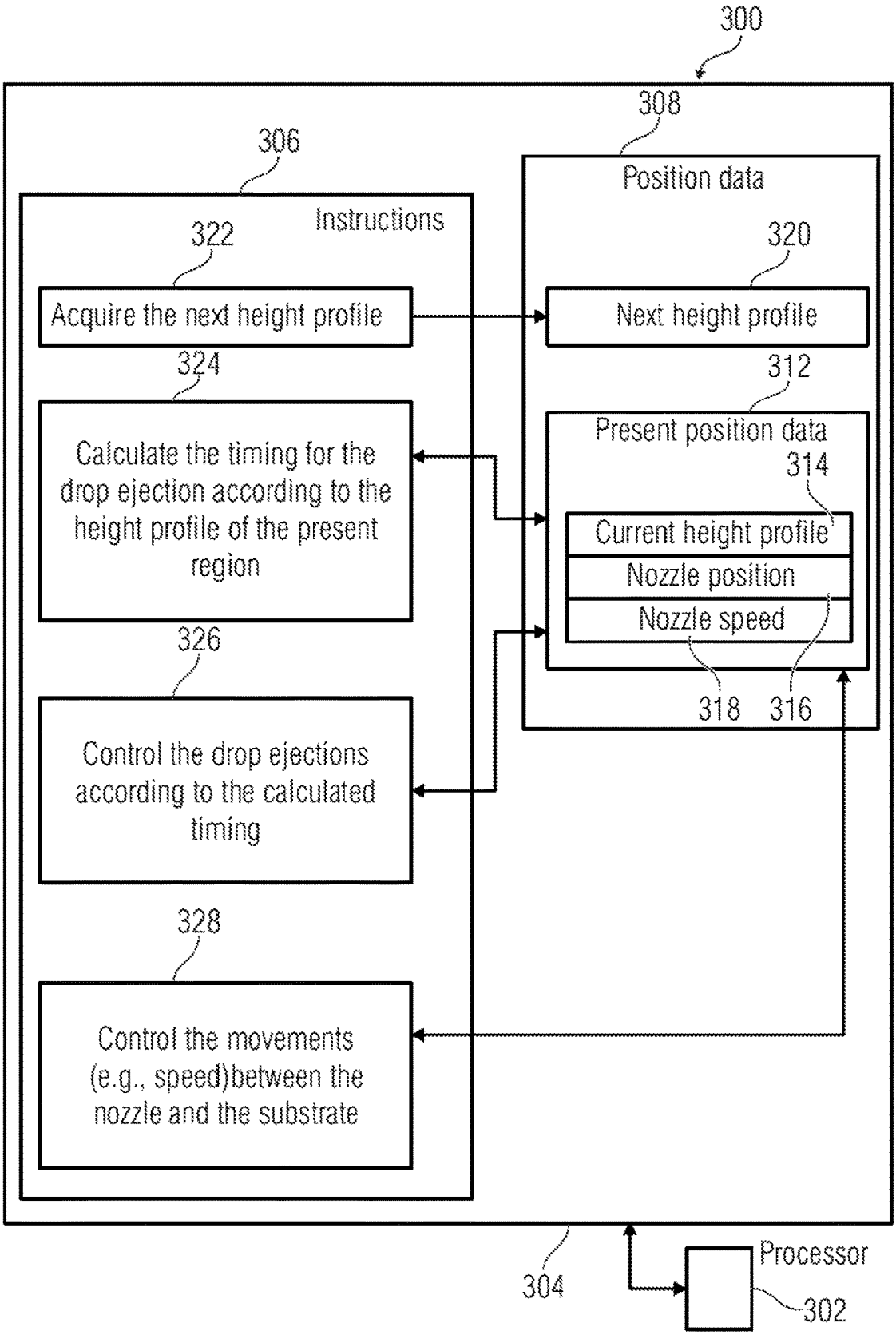
FIG. 3 shows a scheme according to an example.

FIG. 3 shows a system 300 which may be implemented to perform printing fluid ejections, e.g., according to the method 100 or using the equipment discussed above. The system 300 may comprise a processor 302. The system 300 may comprise a storage assembly 304. The storage assembly 304 may be implemented as comprising a plurality of storage media. The storage assembly 304 may comprise a non-transitory computer-readable storage medium 306 containing instructions which, when running on a computer (in particular on the processor 302) cause the computer to dynamically control drop ejection based on print-to-substrate distances measured by a distance detector (e.g., the detector 26).

The storage assembly 304 may also comprise a storage medium (e.g., read-write memory, such as a random access memory, RAM) 308. In the storage medium 308, position data associated to the regions on which it is to be printed may be stored. In the storage medium 308, the position of the nozzle in relationship to these regions may be stored in real time. In the storage medium 308, data relating to the timing of the nozzle ejections (e.g., in relationship to the height profile of the print region of the substrate) may be stored.

The storage medium 308 may comprise a memory space 312 to store present position data. The present position data may be used, for example, while performing the session of dynamically controlling the timings of printing fluid, e.g., at block 102. For example, the memory space 312 may comprise a memory space 314 to store the height profile of the substrate region on which the printer is currently printing (print zone). The memory space 312 may be organized as an array, a list, a database, or the like. The memory space 312 may contain, at each memory location, a data regarding the height of the gap at a location in the print zone. In some examples, from the instant at which the nozzle starts applying printing fluid on a print zone to the instant in which the nozzle ends to apply printing fluid on the same print zone (e.g., from the start to the end of a swath), the memory space 314 is not modified (e.g., by virtue of the current height profile having been previously acquired). The memory space 314 may be subsequently updated (e.g., by storing the profile height of the subsequent region to be printed on) when the printer has ended to apply printing fluid on the print zone and the pre-print zone becomes the new print zone.

The memory space 312 may comprise a memory space 316 to store the current nozzle position with respect to the substrate. For example, the current nozzle position may be expressed as a Cartesian reference coordinate in the axis x and an in the axis y. The nozzle position may be updated at any relative movement between the substrate and the nozzle. Notably, the nozzle position in the memory space 316 may have a correspondence to one of the positions of the current height profile in memory space 314. For example, an association (e.g. a pointer) between the nozzle position in the memory space 316 and the height profile in the memory space 314 may be defined. By associating the height of the gap of a region on which printing fluid is to be applied (as contained in a memory location of the memory space 314) and the current nozzle position (contained in the memory space 316), the processor 302 is provided in real time with information which permit to perform the timing of the printing fluid drop ejection.

The memory space 312 may comprise a memory space 318 to store the current nozzle (printhead) speed. The nozzle speed may be calculated as the ratio between the distance, in the scan direction y, between two positions of the nozzle and the time to cover this distance. As explained above, the nozzle speed may be used to calculate the trajectory of the printing fluid drops. In some examples, the nozzle speed is constant and may be stored, e.g., in a read-only memory space.

The storage medium 308 may also comprise a memory space 320 to store a height profile of the pre-print zone. The memory space 320 may be updated, for example, in the session of measuring the height profile, e.g., at block 104. The memory space 320 may contain a plurality of memory locations, each of which may be associated to different coordinates in the axis x. Each of the locations of the pre-print zone may be updated in real-time with a height value, e.g., a value associated to the distance between the printhead and the substrate (e.g., as measured by the distance detector 26).

With reference to the example of FIG. 2*c*, while the nozzle 22 is in the process of firing printing fluid on the print zone 24*c*, the distance detector 26 is acquiring a height profile of the pre-print zone 24*c*'. Meanwhile, in the memory space 320, memory locations associated to points in the pre-print zone 24*c*' are updated in real time with the values acquired by the distance detector 26. This process may be repeated for each measured point of the pre-print zone 24*c*' until the printhead has completed the current swath. At that instant, all the memory locations of the memory space 320 contain height values of the pre-print zone 24*c*'. Then, the pre-print zone becomes the print zone and the height values of the memory space 320 may be copied on the memory space 314.

The non-transitory computer-readable storage medium 306 may contain instructions which, when running on the processor 302, may permit to control the timing of the nozzle.

In particular, the non-transitory computer-readable storage medium 306 may comprise a memory space 322 with instructions for acquiring the height profile of the pre-print zone. For example, the processor 302 may perform instructions for performing a measuring session of a height profile as defined at block 104. Each height value which is acquired by the distance detector 26 for a particular part of the pre-print zone may be recorded on a respective memory location in the memory space 320.

While the processor 302 is controlling the acquisition of the height profile for the pre-print zone, the processor 302 may also perform other tasks, for example, for performing operations defined at block 102.

The non-transitory computer-readable storage medium 306 may comprise a memory space 324 with instructions for calculating the timing for the drop ejection according to the height profile of the current print region. Accordingly, for each point (e.g., $P_1$) which has to be covered by printing fluid, the data for performing the calculation of the timing may comprise: the current nozzle position (e.g., retrieved from the memory space 316), the height h of the gap at that point (e.g., saved in a memory location of the memory space 314); and the nozzle speed (e.g., retrieved from the memory space 318). Accordingly, it is possible to accurately define the time instant at (and the position from) which a printing fluid drop may be fired from the nozzle 22 towards the intended point.

The non-transitory computer-readable storage medium 306 may comprise a memory space 326 with instructions for controlling in real time the drop ejections according to the calculated timing. The processor 302 may therefore act on an actuator to eject a printing fluid drop from the nozzle at the calculated time instant and from the appropriate nozzle position to eject a printing fluid drop which correctly arrives at the intended point.

The non-transitory computer-readable storage medium 306 may comprise a memory space 328 with instructions for controlling the movements between the substrate and the printhead. For example, the processor 302 may control an actuator to move the substrate in the advance direction (direction y) and/or the printhead in the scan direction (direction x).

Therefore, it is possible to control the movement between the substrate and a nozzle (printhead). Notably, the speed selected for moving the nozzle may be used to calculate the timings of printing fluid drop ejections at performed by the instructions comprised in memory space 324.

The processes 322-328 may be performed simultaneously, in series, or a combination thereof. Techniques of multitasking, time-sharing, and so on, may be implemented. In FIG. 2*c*, while the nozzle 22 is applying printing fluid drops to form printing fluid dots on a print zone 24*c* (block 326), the printhead 20 is moving in the scan direction x and the distance detector 26 is acquiring height values at locations of the pre-print zone 24*c*' (block 328).

Meanwhile, the distance detector 26 may determine a distance between the printhead 20 and the substrate 24 (block 322). The distance detector 26 may be placed on the printhead 26, for example in front of the substrate 24.

Figure 4:
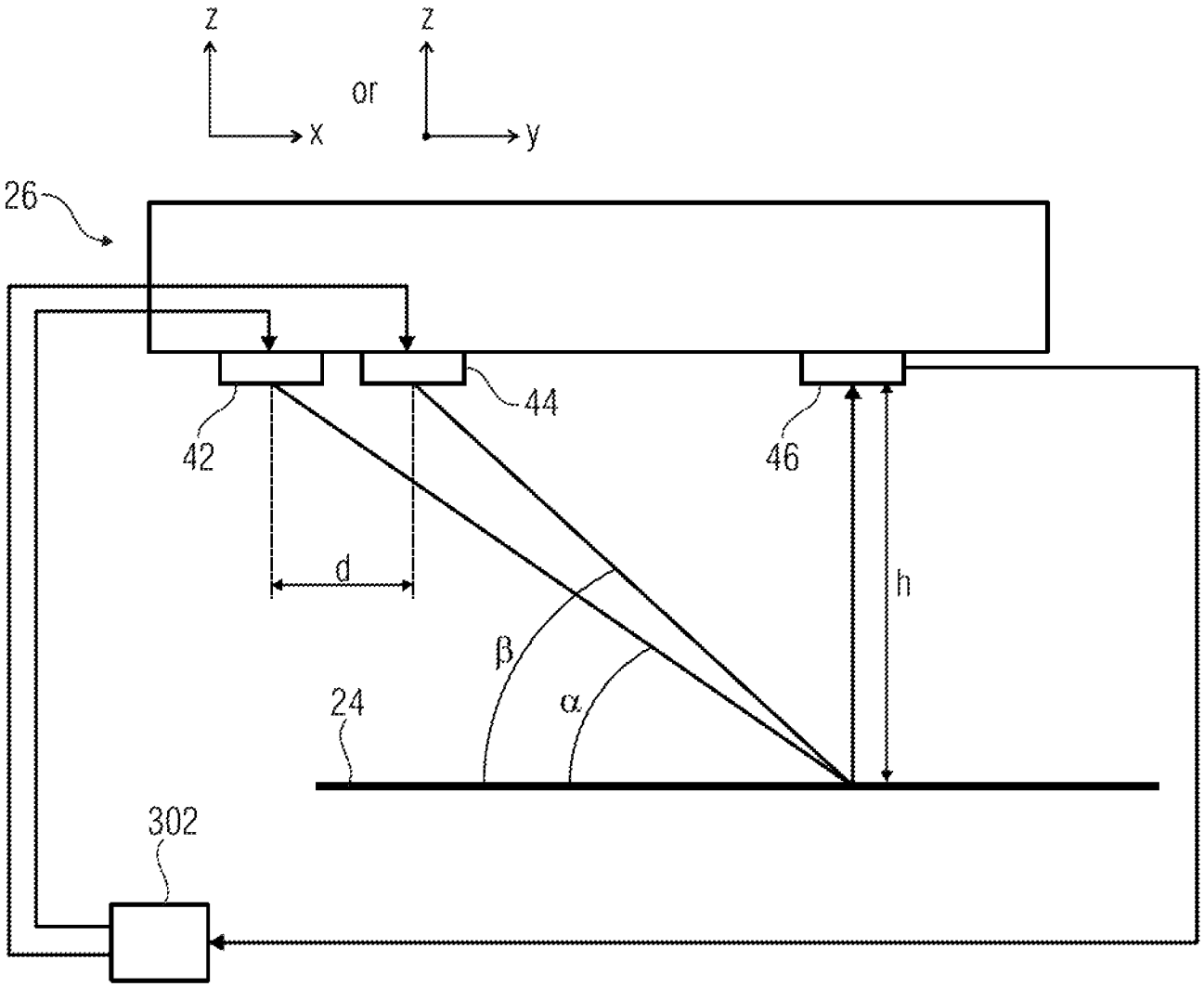
FIG. 4 shows an implementation according to an example.

An example of distance detector 26 is shown in FIG. 4. Telemetry measurements may be performed. The distance detector 26 may include a light source (light emitter). The distance detector 26 may include two light sources, such as a first light source 42 and a second light source 44. The distance detector 26 may comprise a light sensor 46.

The first and second light sources 42, 44 may be light emitting diodes (LEDs). The first and second light sources 42, 44 may illuminate the substrate 24 (in particular, the surface of the substrate on which printing fluid drops are to be placed). The first and second light sources 42, 44 may be positioned so as to have the same distance from the substrate 24. The first and second light sources 42, 44 may be positioned to be in slightly different locations, for example at a distance d (which may be, for example, a distance parallel to the scan direction x or the advance direction y). The first and second light sources 42, 44 may generate the same color or approximately the same colors, such as, for example, two colors which are so similar that their different color has no or negligible consequences on the light detection performed by the light sensor 46.

The light sensor 46 may receive diffuse light generated by the first and second light sources 42, 44 and reflected against the substrate 24. The light sources 42, 44 may be controlled by the processor 302. The light sensor 46 may output a signal (e.g. to the processor 302) which is based on the received light. The light sensor 46 may generate a voltage as a function of the light intensity.

It is possible to measure the distance h between the light sources 42, 44 and the substrate 24. The position of the light sensor 46 may be such that light paths of light generated by each of the light sources 42, 44 are subjected to different angles $\alpha$ and $\beta$ before arriving at the light sensor 46.

Light reflected by the substrate 24 may be received by the light sensor 46. By sequentially measuring the intensity of the light from each light source 42, 44, using the sensor and calculating the ratio of the result, it is possible to determine the distance h between the printhead and the substrate 44.

Light generated by the first and second light sources 42, 44 may be reflected by the substrate 24 according to different reflection angles $\alpha$ and $\beta$. If the distance h between the light sources 42, 44 and the substrate varies, the intensity of the light generated by each light source shifts accordingly. With reference to FIGS. 2*c* and 2*d*, the values $h_1$ and $h_3$ are different from the value $h_2$ and, therefore, the intensity of the light as measured in correspondence with $h_1$ and $h_3$ is not the same as the intensity of the light as measured in correspondence with $h_2$.

The distance detector 46 may be controlled so that some of its elements are switched independently (e.g., sequentially). For example, the first light source 42 may generate light during a first time slot while the second light source 44 is off. During a subsequent second time slot, the first light source 42 may be turned off and the light source 44 may be turned on, to generate light alone. The light sensor 46 may measure intensity of the reflected light transmitted by each light source 42, 44 at different time slots. As the angle $\alpha$ of reflection of the light generated by the first light source 42 is different from the angle $\beta$ of reflection of the light generated by the second light source 44, the measured intensity of the light generated by the first light source 42 is in general different from the measured intensity of the light generated by the second light source 44. However, the ratio between the intensity value of the light from the first light source 42 and the intensity value of the light from the second light source 44 in general depends on the distance between the light detector and the substrate. Therefore, the ratio may be used to measure the distance h between the printhead and the substrate. Each ratio (or range of ratios) may be associated to a different height value. A look-up table may be used: each height value h may be retrieved in the look-up table in correspondence with a ratio (or a range of ratios). The retrieved height value h may be stored (as an entry of the next height profile) in the memory space 320, and in particular in a memory location which is associated to the point whose height has been measured, for a drop ejection to be performed subsequently (e.g., at the next swath).

It is possible to sequentially alternate the time slots in which only the first light source 42 is on and the time slots in which only the light source 44 is on so as to obtain a plurality of intensity values associated to the first light source 42 and a plurality of intensity values associated to the second light source 44 and to average them before calculating the ratio.

The printhead 26 may move along the scan direction x while the first and second light sources 42, 44 are alternatively transmitting light. However, operations such as sequentially switching on/off each light source, acquiring the light intensity, calculating the averages and the ratio, retrieving a height value in the look-up table, and saving the height value in the memory space 320, are extremely quick. Therefore, it is possible to associate a particular height value to each printing fluid dot which is to be generated by a printing fluid drop.

The data acquisition and the calculation of the distance (e.g., by calculating the ratio) may be performed according to the instructions for acquiring the subsequent height profile stored in the memory space 320.

Figure 5:
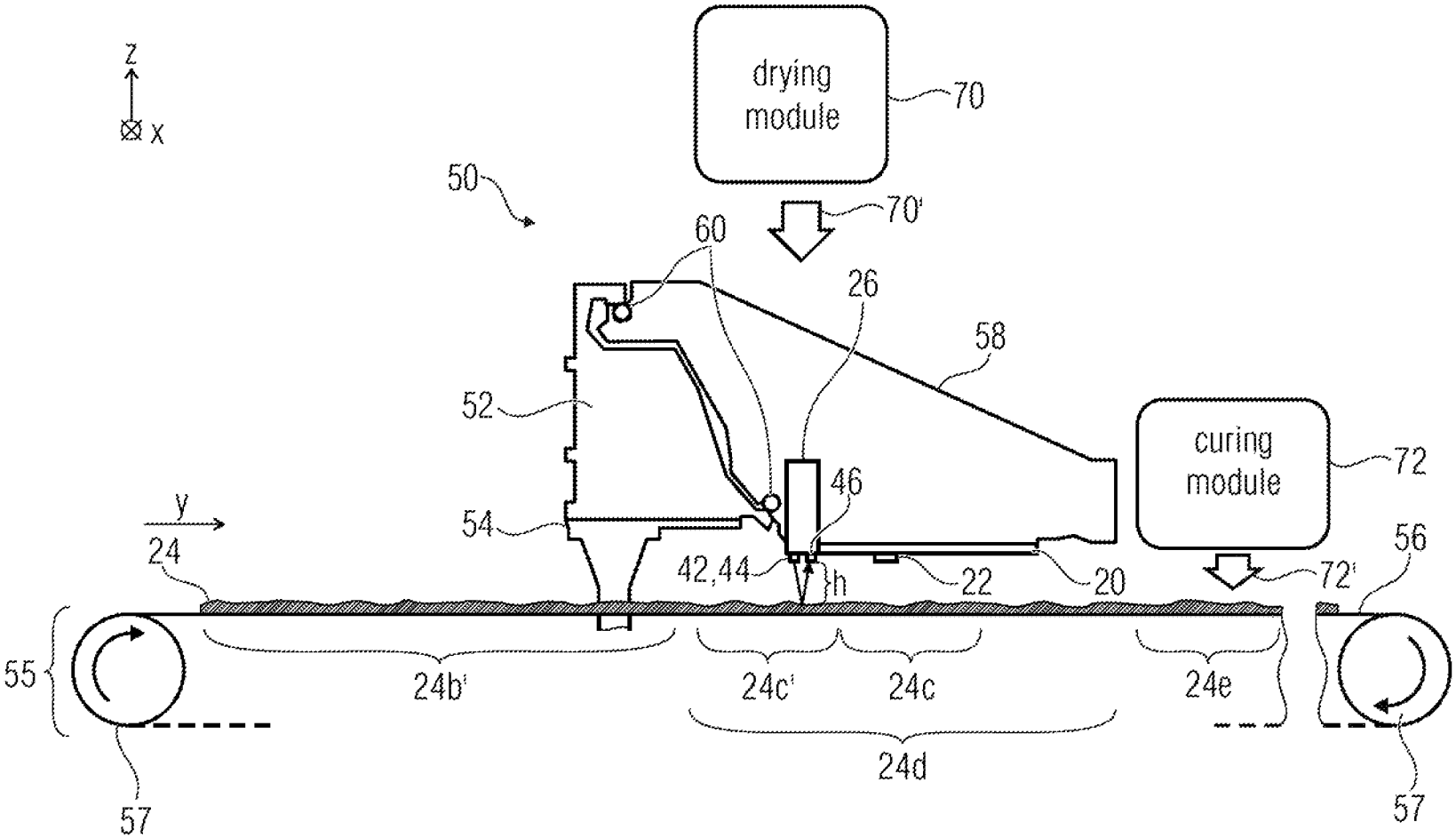
FIG. 5 shows a lateral view of a printer according to an example.
Figure 6:
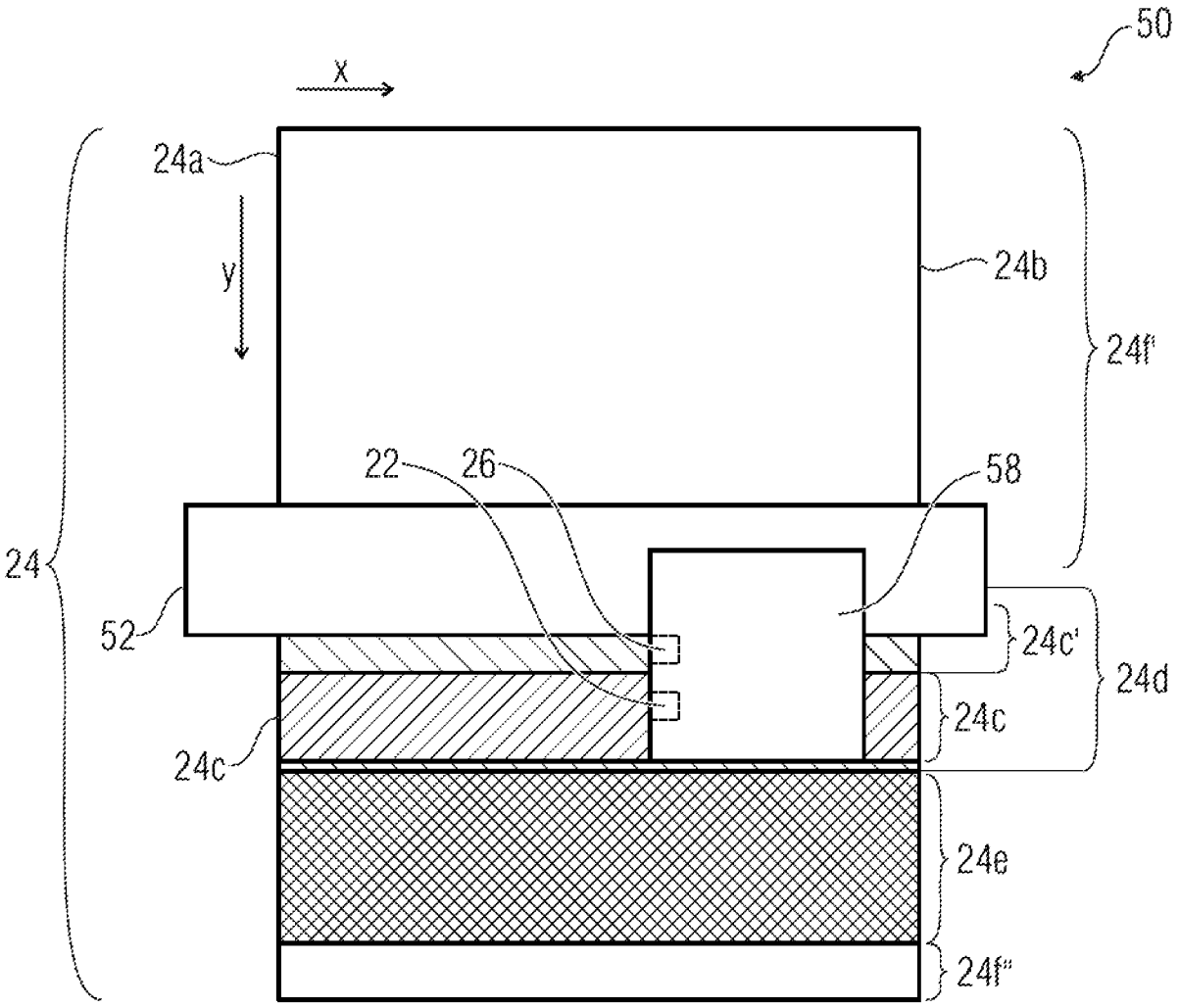
FIG. 6 shows a view from above of the printer of FIG. 5.

FIGS. 5 and 6 show an example of a printer 50. The printer 50 may be an ink-jet printer, such as a latex ink printer. The printer 50 may be controlled by a processor such as the processor 302. The printer 50 may perform some of the operations discussed above and may comprise some of the components described above.

The printer 50 may be controlled so as to concurrently perform two session. A first session may be a session of dynamically controlling the timings of printing fluid drop ejections to deposit printing fluid on a print zone (e.g., zone 24*c*), while a second session may be a session of measuring a height profile of a pre-print zone (e.g., zone 24*c*').

The printer 50 may comprise a beam 52 which may be fixed. The beam 52 may be sustained by lateral vertical elements 54, such as two pillars. The printer 50 may comprise an advance device 55 to move a substrate 24 along the advance direction y. The advance device 55 may comprise a belt 56 which translates along the advance direction y. The advance device 55 may comprise rollers or drums 57 which may rotate to cause the belt 56 to translate. The rollers or drums 57 may be driven by motors (such as electric motors) which are not shown. Alternatively, linear motors may be used. The motors may be controlled by the processor 302, for example, so as to control the movement of the substrate 24 along the scan direction x.

The printer 50 may comprise a nozzle 22, which may be the nozzle of any of FIGS. 2*a*-2*d*. The printer 50 may comprise a plurality of nozzles, e.g., organized in an array or matrix. Among the plurality, only one nozzle 22 is shown in the figures of the sake of simplicity.

The nozzle 22 may be controlled, for example, by the processor 302, e.g., using some of the operations defined at the blocks 102, 324, and 326, to eject printing fluid drops (e.g., latex ink drops) while moving along the scan direction x.

The printer 50 may comprise a distance detector 26 (which may be the distance detector of any of FIGS. 2*c*, 2*d*, and 4). The distance detector 26 may be controlled, for example, by the processor 302 or using some of the operations defined at the blocks 104 and 322, to determine a height profile while moving along the scan direction x and while the nozzle 22 is ejecting printing fluid drops. The distance detector 26 and the nozzle 22 may be fixedly attached to a printhead 20 (which may be the printhead of FIGS. 2*b*-2*d*) so as to have a fixed distance. The printhead 20 may be a thermal printhead. The printhead 20 may be a piezoelectric printhead. The distance detector 26 and the nozzle 22 may be positioned so as to have the same height in the vertical direction z.

In order to move the nozzle 22 and the distance detector 26 in the scan direction x, a carriage 58 may be provided. The printhead 20 may be mounted on the carriage 58, so as to face the substrate 24. A gap is interposed between the printhead 20 (and in particular the nozzle 22 and the distance detector 26) and the substrate 24 (or the belt 56 when the substrate 24 is not present). The gap has a height h which is in general variable and whose profile may be measured by the distance detector 26.

The carriage 58 may be sustained by rods 60 which may extend in the scan direction x and may be supported by the beam 52. The movement of the carriage 58 may be driven by actuators controlled by the processor 302.

When moving along a swath, the carriage 58 may travel along the scan direction x forward or backward. In some examples, at a first swath the carriage 58 moves in the scan direction x from a first border 24*a* (e.g., a left border) of the substrate 24 to a second border 24*b* (e.g., right border). At an immediately subsequent swath, the carriage 58 moves in the scan direction x, backward, i.e., from the second border 24*b* to the first border 24*a*. While moving along the first swath, the nozzle 22 applies printing fluid on a print zone (e.g., region 24*c* in FIGS. 2*c* and 5) and the distance detector 26 measures the gap between the substrate 24 and the printhead 20 in correspondence with a plurality of points of the pre-print zone 24*c*'. Subsequently, the print zone is updated (e.g., the region 24*c*' becomes the print zone as in FIG. 2*d*). Then, while moving along the second swath, the nozzle 22 applies printing fluid on the print zone (region 24*c*') and the distance detector 26 measures the gap between the substrate 24 and the printhead 20 in correspondence with a plurality of points of the pre-print zone (region 24*c*").

In some cases, e.g., if the printer 50 is a latex ink printer, the printer may also comprise heating elements, which may define different temperature sections, e.g., along the advance direction y. The heating elements may modify the temperature of the substrate along the advance direction y. Therefore, at the same time instant, different portions of the substrate 24 may be at different temperatures. Hence, the substrate 24 may be transported along different sections in the printer which distinguished by different temperatures at which the support is to be subjected. Each of the heating elements may be controlled by the processor 302, for example, to impose a determined temperature to the substrate 24 in each temperature section.

One heating element may be a drying module 70 (FIG. 5). The drying module 70 may be to convey hot air onto the substrate 24 in correspondence with the print zone to dry the latex ink so as to cause evaporation of water contained in the latex ink. In particular, the drying module 70 may convey hot air onto a drying zone of the substrate 24. A drying section 24*d* is therefore defined. The drying module 70 may be placed over the carriage 50. The drying module 70 may force a flux 70' of hot air towards the substrate 24, e.g., along the height direction z. The portion of the substrate 24 which is heated by the drying module 70 (drying zone) is heated at the drying section 24*d*. The drying section 24*d* contains the print zone 24*c*. A temperature for the substrate 24 in the drying section 24*d* may be between 40° C.-60° C., in particular around 54° C.-56° C., more in particular 55° C. Accordingly, latex ink drops are fired in a portion of the substrate 24 which is warm, and water contained in the ink may evaporate.

One heating element of the latex ink printer 50 may be a curing module 72. Them curing module 72 may convey hot air onto the substrate 24 to cure the latex ink pigments. The curing module 72 may define a curing section 24*e*. In correspondence with the curing section 24*e*, a flux 72' of hot air may be conveyed toward a portion of the substrate 24, so that the portion of the substrate which is in the curing section 24*e* tends to be at an intended temperature for curing the printing fluid. The curing module 72 may be placed so as to heat the substrate 24 from above. The curing module 72 may be downstream, in the advance direction y, to the drying module 70. The curing module 72 may force a flux 72' of hot air towards the substrate 24, e.g., along the height direction z. The curing section 24*e* may be in a position which corresponds to portions of the substrate 24 which have already been printed on. The curing module 72 may heat the substrate 24 up to a temperature which may be over 65° C., e.g., up to 75° C. Accordingly, the latex ink on the substrate may be dried. When latex ink is cured, it forms a film in the surface of the substrate 24 which that increases mechanical properties such as scratch resistance and durability without detaching the pigments from the surface of the substrate 24.

In the sections indicated with 24*f*' and 24*f*" (which may be respectively upstream to the drying section 24*d* and downstream to the curing section 24*e*) the substrate 24 may be substantially at ambient temperature.

The portions of the substrate 24 at different temperatures may involve unpredictable deformations. However, by measuring in real time the distance between the nozzle 22 and the substrate 24, it is possible to perform a compensation by modifying the timing of the drop ejection on the basis of the measured height of the gap.

The distance detector 26 may be placed at a position which is upstream to the position of the nozzle 22. The distance detector 26 may be also placed at a position which is in the same temperature section of the nozzle (e.g., the drying section 24*d*). Therefore, the pre-print zone 24*c*' and the print zone 24*c* may be in the same temperature section, in correspondence with portions of the substrate which have a similar temperature. In the case of the latex ink printer, the pre-print zone 24*c*' is already at the temperature for drying the latex ink (e.g., 55° C.) and its height profile along the scan direction x may be accurately acquired.

Depending on certain implementation requirements, examples may be implemented in hardware. The implementation may be performed using a digital storage medium, for example a floppy disk, a Digital Versatile Disc (DVD), a Blu-Ray Disc, a Compact Disc (CD), a Read-only Memory (ROM), a Programmable Read-only Memory (PROM), an Erasable and Programmable Read-only Memory (EPROM), an Electrically Erasable Programmable Read-Only Memory (EEPROM) or a FLASH memory, having electronically readable control signals stored thereon, which cooperate (or are capable of cooperating) with a programmable computer system such that the respective method is performed. Therefore, the digital storage medium may be computer readable.

Generally, examples may be implemented as a computer program product with program instructions, the program instructions being operative for performing one of the methods when the computer program product runs on a computer. The program instructions may for example be stored on a machine readable medium.

Other examples comprise the computer program for performing one of the methods described herein, stored on a machine readable carrier.

In other words, an example of method is, therefore, a computer program having a program instructions for performing one of the methods described herein, when the computer program runs on a computer.

A further example of the methods is, therefore, a data carrier medium (or a digital storage medium, or a computer-readable medium) comprising, recorded thereon, the computer program for performing one of the methods described herein. The data carrier medium, the digital storage medium or the recorded medium are tangible and/or non-transitionary, rather than signals which are intangible and transitory.

A further example of the method is, therefore, a data stream or a sequence of signals representing the computer program for performing one of the methods described herein. The data stream or the sequence of signals may for example be transferred via a data communication connection, for example via the Internet.

A further example comprises a processing means, for example a computer, or a programmable logic device performing one of the methods described herein.

A further example comprises a computer having installed thereon the computer program for performing one of the methods described herein.

A further example comprises an apparatus or a system transferring (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some examples, a programmable logic device (for example, a field programmable gate array) may be used to perform some or all of the functionalities of the methods described herein. In some examples, a field programmable gate array may cooperate with a microprocessor in order to perform one of the methods described herein. Generally, the methods may be performed by any appropriate hardware apparatus.

The above described examples are merely illustrative for the principles discussed above. It is understood that modifications and variations of the arrangements and the details described herein will be apparent. It is the intent, therefore, to be limited by the scope of the impending patent claims and not by the specific details presented by way of description and explanation of the examples herein.

The invention claimed is:

1. A method comprising performing a session of dynamically controlling the timings of printing fluid drop ejections to deposit printing fluid on a print zone of a substrate according to a height profile of the print zone, while performing a session of measuring a height profile of a pre-print zone.

2. The method of claim 1, wherein measuring comprises:

receiving light generated by a plurality of light sources and reflected by the substrate;

calculating a ratio between intensity values associated to light patterns generated by each light source.

3. The method of claim 1, further comprising heating the print zone of the substrate.

4. The method of claim 3, wherein the pre-print zone is in a same temperature section of the print zone.

5. The method of claim 1 further comprising applying the printing fluid to the substrate.

6. The method of claim 1, further comprising controlling a movement between the substrate and a nozzle applying the printing fluid to the substrate, wherein dynamically controlling the timings of printing fluid drop ejections is further based on the relative speed between the substrate and a nozzle.

7. The method of claim 1, further comprising:

heating a portion of the substrate; and wherein measuring the height profile comprises measuring an irregular height profile of the substrate in the pre-print zone caused by temperature differences to which the substrate is subject.

8. A system comprising:

a printhead to deposit a printing fluid onto a substrate while moving in a scan direction that crosses an advance direction in which the substrate is advanced below the printhead, a distance detector upstream from the printhead in the advance direction, the distance detector to detect, while the printhead moves in the scan direction, printhead-to-substrate distances of a pre-print zone, an actuator to move the substrate in the advance direction such that an advancing portion of the substrate from the pre-print zone is advanced into a print zone below the printhead, where printing fluid is to be subsequently deposited on the advancing portion of the substrate, and a processor, wherein the processor of the system is to dynamically control the timing of drop ejections from the printhead to the advancing portion of the substrate based on the printhead-to-substrate distances.

9. The system of claim 8, wherein the distance detector comprises a light emitter and a sensor which is to output an electric value associated to a light intensity of light generated by the light emitter and reflected by the substrate.

10. The system of claim 8, further comprising a heating device to heat a portion of the substrate, wherein the distance detector is placed to measure the printhead-to-substrate distances in the pre-print zone where the substrate is heated by the heating device.

11. The system of claim 8, wherein the system is to dynamically control the timing of the drop ejections based on a relative speed between the printhead and the substrate.

12. The system of claim 8, wherein the processor is to:

compare each detected printhead-to-substrate distance to a threshold height, and advance or delay a timing for a corresponding drop ejection relative to a threshold time based on a difference between that detected printhead-to-substrate distance and the threshold height.

13. The system of claim 8, wherein the printhead and distance detector are located on a common carriage for movement in the scan direction.

14. The system of claim 8, further comprising a memory with a first number of memory locations, each memory location corresponding to and storing one of the printhead-to-substrate distances from the pre-print zone, wherein the processor is to copy data from the first number of memory locations to a different memory space between the distance detector detecting the printhead-to-substrate distances and the processor dynamically controlling the timing of drop ejections based on the detected printhead-to-substrate distances.

15. The system of claim 8, wherein the distance detector comprises:

two light emitters spaced at a distance from each other; and a light sensor;

wherein the two light emitter sequentially emit light to the substrate in the pre-print zone, the light sensor comparing light received sequentially from the two light emitters to determine a printhead-to-substrate distance.

16. The system of claim 15, further comprising a look-up-table that lists a printhead-to-substrate distance corresponding to each of a number of ratios of light received from a first of the light emitters to light received from a second of the light emitters.

17. A non-transitory computer readable device having instructions which, when executed by a processor, cause the processor to:

calculate the timing for drop ejection by a printhead according to a height profile of a first print region where the height profile was measured when the first print region was in a pre-print zone upstream from the printhead, control the drop ejections according to the calculated timing, control movements between the printhead and the substrate; and, concurrently, acquire a second height profile of a second region to be printed on subsequently while the second region is in the heated pre-print zone.

18. The non-transitory computer readable device of claim 17, further comprising instructions which cause the processor to store the acquired second height profile of the second region in memory locations of a first memory space, each memory location being associated to a particular part of the second region.

19. The non-transitory computer readable device of claim 18, further comprising instructions which cause the processor to copy height values of the second region to a second memory space to be used to control drop ejection in the second region.

20. The non-transitory computer readable device of claim 17, further comprising instructions which cause the processor to determine a distance value based on sensing a light intensity of light generated by a light source.

* * * * *